United States Patent [19]

Pommier

[11] Patent Number: 5,038,008

[45] Date of Patent: Aug. 6, 1991

[54] MEMBER FOR CONTROLLING A DEVICE SUCH AS AN ELECTRIC SWITCH OF THE KIND SHAPED AS A PIVOTING LEVER

[75] Inventor: Louis Pommier, Yerres, France

[73] Assignee: Mors, France

[21] Appl. No.: 440,816

[22] Filed: Nov. 22, 1989

Related U.S. Application Data

[63] Continuation-in-part of Ser. No. 154,933, Feb. 10, 1988, abandoned.

[30] Foreign Application Priority Data

Feb. 10, 1987 [FR] France ..... 87 01645

[51] Int. Cl.[5] ..... H01H 9/16

[52] U.S. Cl. ..... 200/339; 200/309

[58] Field of Search ..... 200/339, 315, 309

[56] References Cited

U.S. PATENT DOCUMENTS 4,436,972 3/1984 Scanlon ..... 200/315

*Primary Examiner*—Renee S. Luebke

*Attorney, Agent, or Firm*—Steinberg & Raskin

[57] ABSTRACT

A member for controlling a device of the type shaped as a pivoting lever mounted in a case so that at least one end thereof may swing between a position retracted into the case and a position in which it would project at least partially from the case to be visible, at least one portion of the outer surface of the visible part of that end being colored to show the operating state of the device colored surface of the indicating portion is the surface of a separately made piece and the lever end is shaped to allow a removable assembling of the piece onto the lever, this being applicable to an electric switch operating handle or grip.

6 Claims, 2 Drawing Sheets

6
7a
7b
8
15a
15b
α
1
2
3
4
16
A
B
10
10a
10b
10c
11
13
I
III

FIG. 5
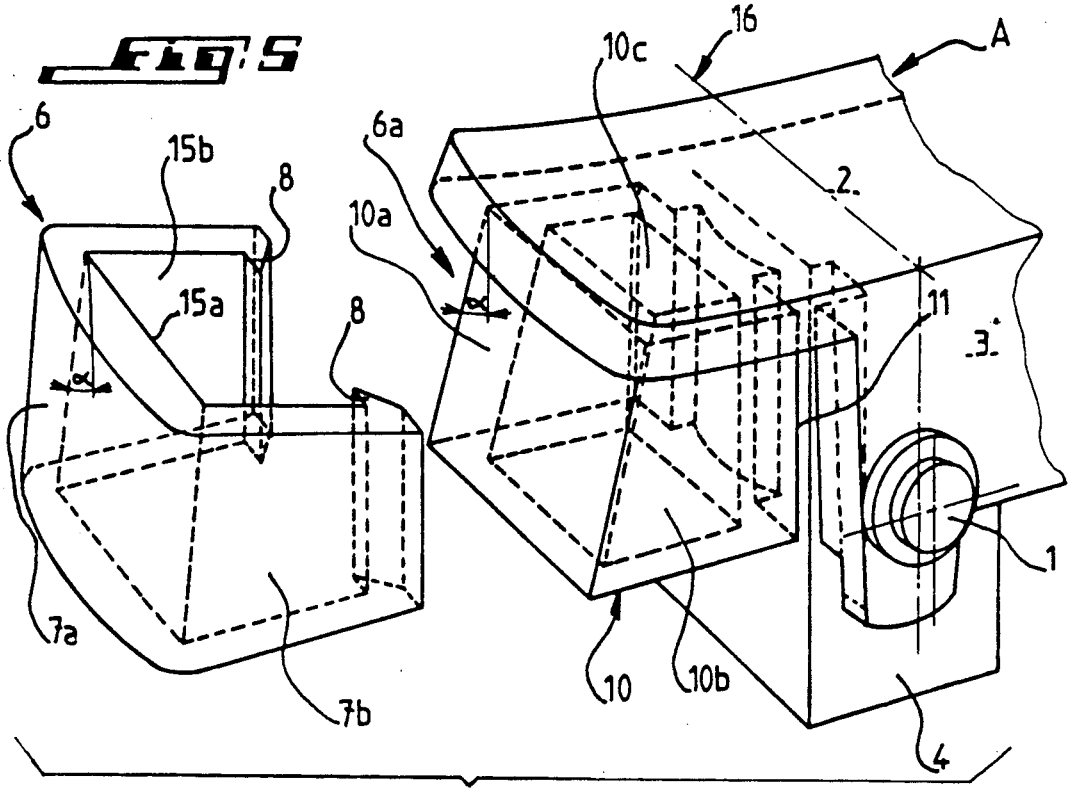
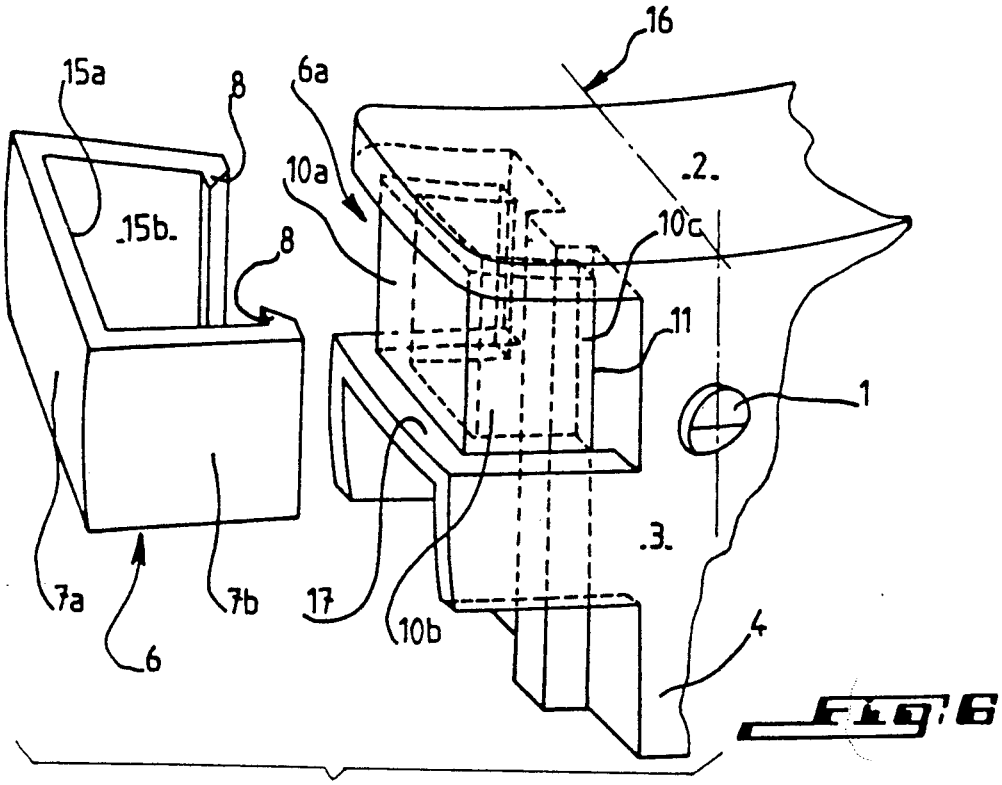
FIG. 6

MEMBER FOR CONTROLLING A DEVICE SUCH AS AN ELECTRIC SWITCH OF THE KIND SHAPED AS A PIVOTING LEVER

This is a continuation in part of U.S. Patent application Ser. No. 154,933, filed Feb. 10, 1988, now abandoned.

BACKGROUND OF THE INVENTION

The present invention relates essentially to a member for controlling or operating a device such as an electric switch of the kind shaped as a lever mounted in pivoting or swinging relationship in a box or casing so that at least one end thereof is pivotable or swingable between a position retracted into the casing and a position in which it projects at least partially from the casing to be visible, at least one zone of the outer surface area of the visible part of the end being colored to show the operating state or working condition of the device.

The problem of coloring the visible zone has not been solved in a satisfactory manner until now. With a known type of switch lever, this zone is painted or a color film is applied thereon for instance through adhesive bonding, sticking or gluing. In both cases, the layer or coating or the superficially applied film does not withstand friction, attrition or wear for a long time. It may vanish with the passage of time or be removed thereby, giving rise to a serious safety problem. To avoid this difficulty, a colored signalling zone has been provided in a material which exhibits a color differing from the remainder of the lever upon integrally moulding the lever in one single piece. This method of manufacturing the lever suffers from the major inconvenience of being complicated and expensive.

SUMMARY OF THE INVENTION

The object of the invention is to provide a control member of the type defined hereinabove which may be made in a simple and cheap manner while removing any risk of altering the zone for indicating or signalling the state of the switch.

To reach this goal, the control member according to the invention is characterized in that the colored surface area of the indicating or signalling zone is the surface of a separately made part or piece and in that the end of the lever is shaped to allow an advantageously removable assembly of said part or piece onto the lever.

According to an advantageous characterizing feature of the invention, the separate piece is made in particular through moulding from a material of a color differing from that of the lever.

According to another advantageous characterizing feature of the invention, the separate piece has a generally U-shaped cross-section in a plane substantially parallel to the lever operating surface and the visualizing display or signalling end has a structure adapted for supporting and assembling said U-shaped piece.

According to still another characterizing feature of the invention, those ends of the walls of the piece which form the legs of the U-shaped exhibit projections extending inwardly of the U-shaped substantially at right angles to the walls thereof and the support structure of the lever comprises elements providing for the fastening of the piece through engagement or snapping of said projections into these elements.

BRIEF DESCRIPTION OF THE DRAWINGS

The invention will be better understood and further objects, characterizing features, details and advantages thereof will appear more clearly as the following explanatory description proceeds with reference to the accompanying diagrammatic drawings given by way of non-limiting example only illustrating a presently preferred specific embodiment of the invention and wherein:

FIG. 5 is an exploded view of the control member according to the FIGS. 1 to 4; and FIG. 6 is an exploded view of a second embodiment of a control member according to the invention.

DESCRIPTION OF THE PREFERRED EMBODIMENTS

Figures 1, 2, 3, 4:
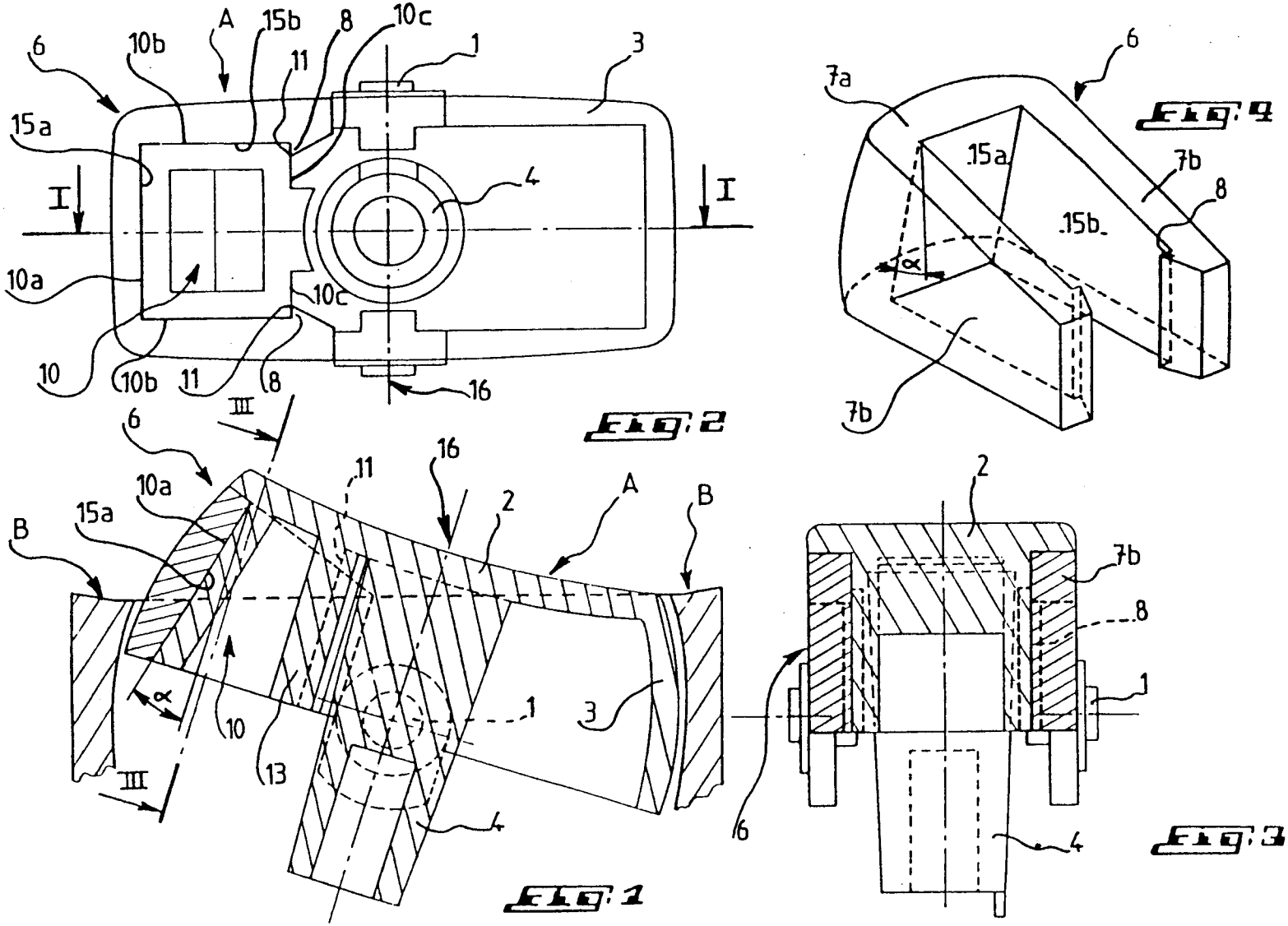
FIG. 1 is a view in cross-section taken upon the line I—I of FIG. 2 showing a first embodiment of a control member according to the invention.
FIG. 2 is a bottom view of the control member shown on FIG. 1.
FIG. 3 is a view in cross-section taken upon the line III—III of FIG. 1.
FIG. 4 is a perspective view of the separate piece of a control member according to the present invention.

The Figures show a control member A shaped as a pivoting or swinging lever with two arms or shaped as a handle or grip and adapted to fit an electric switch. The operating or control lever is adapted to be mounted in pivoting or swinging relationship onto the framing or surrounding walls B of the open upper end of a switch box or case accommodating or housing the electric contact device operated by the lever shown according to the invention. Switch boxes or cases of this kind are known per se, the case not having been shown. At 1 are shown the pivot-like tips or pintles for mounting the lever into the framing structure.

The control lever according to the invention comprises an actuating top wall 2 and side walls 3 which are shaped to extend substantially at right angles inwards of the case from the wall 2. It is seen that the pivot-like tips or pintles 1 are provided on the outer side faces of the lever. At 4 is shown the plunger of the lever which is adapted to act upon the electric contact device.

The switch according to the invention is mounted within a box, case or like housing so that its two ends may pivot or swing between a lower position in which the actuating top surface is practically on the same level as the upper edge of the framing structure B, as diagrammatically shown on the right-hand side of FIG. 1, and an upper position in which a substantial zone of the end is projecting from the case and visible from the three sides. This position is diagrammatically shown on the left-hand side of FIG. 1.

One of the two ends, namely in the example shown at the end of the left-hand side carries a piece or part 6 which is removably mounted onto a lever indentation or recess lever portion 6*a* having a shape corresponding to the piece 6. According to the FIGS. 4, 5 and 6 which are perspective views, the piece 6 has a generally U-shaped cross-section in a plane substantially parallel to the actuating surface of the lever and comprises a base wall 7*a* extending substantially in parallel relationship to the axis of the pivot tips 1 and side walls 7*b* which extend perpendicularly from the base wall and form the legs of the U-shaped piece. The base wall 7*a* forms the front wall of the lever end and the outer surfaces of the front wall and the side walls are adapted so that, when the piece is assembled to the lever, these surfaces exhibit on the left side of the lever the same outline as on the right side. The ends of the side walls 7*b* of the legs of the U-shaped configuration exhibit projections 8 which extend substantially at right angles inwardly of the U-shaped configuration to form engaging or locking hooks, projections or like dogs. The height of the piece 6 may be greater on the side opposite to the end carrying the projections 8. The piece 6 is made separately from the remainder of the lever and preferably from a material of a color different from that of the lever.

As set forth above the left arm of the lever is shaped to carry the element 6. For that purpose, it has a supporting structure 10 which extends from the actuating top wall 2 inwardly of the case. The outer faces constitute the bottom of the recessed lever portion 6*a* as is clearly shown on the FIG. 5. This structure 10 has a substantially rectangular cross-section in a plane parallel to that wall (FIG. 2), in a manner complementary to or mating with the cross-section of the piece 6. The structure 10 comprises substantially plane side surfaces 10*a*, 10*b* and 10*c* forming respectively the front face, the parallel side faces and rear face portions opposite to the front face. The front face 10*a* and the side faces 10*b* are complementary to the inner faces 15*a*, 15*b* of hte U-shaped piece 6. As well shown on FIG. 2, the piece 6 and the structure 10 are shaped to allow an advantageously removable mounting of the piece 6 onto the support arm of the switch lever, the projections 8 of the piece 6 coming into engagement behind the zones 11 of the rear face 10*c* adjacent to the edges formed by the faces 10*b* and 10*c* of the structure 10. An assembly through locking or snapping engagement is thus obtained.

From FIGS. 1, 4 and 5 it is seen that the front face 10*a* extends in a divergent way from the top wall 2 with respect to the locking zones 11 of the rear face 10*c* extending in parallel relationship to the middle transverse plane 16 (FIGS. 1, 2, 4) defined by the pivot pins 1 and the axis of the plunger 4. This divergent orientation is indicated on the Figures by the angle $\alpha$. The inner face 15*a* of the base or front wall 7*a* of the piece 6 is complementarily inclined according to the angle $\alpha$ so that the piece 6 when mounted on the structure 10 is impeded from moving thereon perpendicularly to the wall 2, whereas the hook like projections 8 prevent a movement in parallel relationship to the top wall 2. Thus a reliable locking of the piece 6 onto the arm of the lever is ensured. The piece 6 can only be disengaged from the lever support structure 10 by resiliently outwardly spreading the ends of its side walls or legs 7*b*.

As clearly shown on FIG. 1, in the position shown, the left end of the lever which carries the piece 6 is projecting from the surrounding or framing structure B. By making the piece 6 for instance from a material of red color, the pivoting or swinging condition of the control lever A is clearly visible from the three sides. Thus, the state of the electric switch is clearly displayed. Since the piece 6 is made as a whole from a material for instance of red color, the visible signalling zone or portion of the lever is not at all subjected or exposed to wear phenomena or to any other kind of alteration likely to make the color indicating the operating state of the device vanish. The detachable assembly of the piece 6 allows the replacement of this piece by another one having for instance another color. As the piece 6 remains, even in its visible position, partially inserted into the case, it may not be removed without previously disassembling the lever A from the framing or surrounding structure B.

It would also be possible to contemplate making the piece 6 from a translucent material and to place inside of the case a lamp the light of which would then be visible from the three sides.

FIG. 6 shows a second embodiment of a control member according to the invention. In this Figure the elements already shown in the first embodiment according to FIGS. 1 to 5 have the same reference numerals. In this second embodiment the recess portion for receiving the piece 6 is cut out at all sides in the side walls 3 of the lever, even at its lower end defined by the U-shaped shoulder face 17. It should further be noted that in the front face 10*a* the recess or indentation forming the support structure 10 extends in parallel relationship to the locking surface zones 11 of the rear face 10*c* of the structure 10. In this embodiment the piece 6 is held in its position on the lever between the top wall 2 and the shoulder face 17 opposite to the wall 2 and thus perpendicular movement to the top wall is impeded. In a complementary manner to the face 10*a*, the inner face 15*a* of the front wall of the piece 6 needs now also need not be inclined with respect to the locking face portions 11 of the structure 10.

What is claimed is:

1. A member for controlling a device such as an electric switch, said member being shaped as a lever (A) having an arm with an end and pivotally mounted in an aperature of a case (B) in a manner such that said end of said lever arm is mounted pivotally about a pivot axis provided in said case, between two different working positions, namely a first working position in which said lever arm end is retracted into said case and a second working position in which said lever arm end projects at least partially outside said case, said lever (A) an actuating top wall (2) and peripheral side walls (3) extending substantially at right angles from said top wall into said case (B) when said lever is pivotally mounted on said pivot axis (1), said peripheral side walls comprising for the lever arm a front end wall extending substantially parallel to said pivot axis (1) and parallel side walls extending substantially perpendicularly to said pivot axis, said lever arm comprising in said front end wall and said parallel side walls an indentation (6*a*) extending thereabout between said top wall and an opposite bottom end of said lever (A) and situated within said case (B) when said lever is pivotally mounted on said pivot axis and said one end is in said second position, said indentation (6*a*) being substantially U-shaped with a base indentation portion (10*a*) in said front end wall and side indentation portions (10*b*) in said side walls of said lever arm extending from said base portion (10*a*) to a location adjacent to a plane (16) extending perpendicularly to said top wall (2) through said pivot axis;

said member further comprising a separate U-shaped piece (6) complementary to said U-shaped indentation (6*a*);

said separate piece (6) and said indentation surface being arranged to mate with one another such that said U-shaped piece (6) is capable of being mounted on said lever and being engaged in said indentation;

said top wall having a color and said separate piece having a color different from the color of said top wall (2) to allow distinguishing between said first and second working positions, and whereby, an individual standing to a side of said lever is able to ascertain said positions of said lever based upon visibility of said separate piece (6) mounted on said lever (A).

2. The member according to claim 1, wherein said separate piece (6) comprises at the free ends of the legs of its generally U-shaped configuration projections (8) extending inwardly from inner surfaces (15*b*) of said legs and said side faces of said indentation comprising corresponding locking zones (11) adapted to enable said projections to come into releasable locking engagement therein.

3. The member according to claim 1, wherein a front face (10*a*) of said indentation (6*a*) extends from said top wall (2) in a diverging manner with respect to said plane (16) through said pivot axis and perpendicular to said top wall (2) so that said separate piece (6) when mounted on said lever by engagement in said indentation (6*a*) is impeded to move in a direction of displacement of said one lever end.

4. The member according to claim 1, wherein said indentation (6*a*) comprises at its end opposite to said top wall (2) a U-shaped shoulder face (17) extending from the outer surface of said lever sidewalls (3) within said indention (6*a*) and wherein said separate piece (6) is adapted to bear against said shoulder surface when being mounted on said lever.

5. The member according to claim 1, wherein said pivoting lever (A) has two arms substantially symmetrical with one another with respect to said plane (16) through said pivot axis (1) and perpendicular to said top wall (2), the longitudinal side walls of said lever carrying cylindrical pintles forming pivots to engage bearing-like holes of said case and at least one of said arms is shaped so as to be adapted to receive said separate piece (6).

6. The member according to claim 1, wherein said separate piece is made from translucent materials and a lamp is provided inside of said case so that its light is visible from three sides through said piece.

* * * * *